US006246006B1

(12) United States Patent
Hardin et al.

(10) Patent No.: US 6,246,006 B1
(45) **Date of Patent: *Jun. 12, 2001**

(54) SHIELDED CABLE AND METHOD OF MAKING SAME

(75) Inventors: Stanley D. Hardin, Conover; Christopher A. Story; Robert A. Wessels, both of Hickory, all of NC (US)

(73) Assignee: CommScope Properties, LLC, Sparks, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,789

(22) Filed: May 1, 1998

(51) Int. Cl.[7] ..... H01B 11/20

(52) U.S. Cl. ..... 174/106 R; 174/109; 174/121 A

(58) Field of Search ..... 174/106 R, 108, 174/36, 109, 121 R, 121 A, 122 R; 333/96, 243

(56) References Cited

U.S. PATENT DOCUMENTS

| | | |
|---|---|---|
| Re. 17,850 | 10/1930 | Hoeftmann . |
| Re. 30,228 | 3/1980 | Silver et al. . |
| Re. 31,277 | 6/1983 | Gabriel et al. . |

(List continued on next page.)

FOREIGN PATENT DOCUMENTS

| | | |
|---|---|---|
| 604614 | 9/1960 | (CA) . |
| 82141 | 1/1920 | (CH) . |
| 81508 | 2/1894 | (DE) . |
| 1540587 | 1/1970 | (DE) . |
| 2915740 | 11/1980 | (DE) . |
| 3141636 A1 | 5/1983 | (DE) . |
| 3347196 | 7/1985 | (DE) . |
| 3615281 | 11/1987 | (DE) . |
| 3931741 A1 | 3/1990 | (DE) . |
| 19620024 A1 | 11/1997 | (DE) . |
| 504776 | 9/1992 | (EP) . |
| 47239 | 2/1937 | (FR) . |
| 2219498 | 9/1974 | (FR) . |
| 2514189 | 10/1981 | (FR) . |
| 1375677 | 11/1974 | (GB) . |
| 1393432 | 5/1975 | (GB) . |
| 1421796 | 1/1976 | (GB) . |
| 2106306 | 4/1983 | (GB) . |
| 52-106483 | 9/1977 | (JP) . |
| 58-204417 | 11/1983 | (JP) . |
| 58-225507 | 12/1983 | (JP) . |
| 61-47017 | 3/1986 | (JP) . |
| 61-71915 | 5/1986 | (JP) . |
| 61-120119 | 7/1986 | (JP) . |
| 61-211910 | 9/1986 | (JP) . |
| 63-56520 | 4/1988 | (JP) . |
| 63-187227 | 11/1988 | (JP) . |
| 4-127918 | 11/1992 | (JP) . |

OTHER PUBLICATIONS

International Search Report, dated Jul. 16, 1999, for PCT application US99/08465, filed Apr. 22, 1999.

*PARAMEDROP™ 68 series TV House Drop Coaxial Cable*, Supersedes Catalog from Comm/Scope Company (May, 1974), pp. 9–10.

*Primary Examiner*—Dean A. Reichard
*Assistant Examiner*—Chau N. Nguyen
(74) *Attorney, Agent, or Firm*—Alston & Bird LLP

(57) ABSTRACT

The present invention provides a non-braided shielded drop cable that can be easily attached to a standard connector. The cable includes a cable core including a center conductor and a dielectric layer surrounding the center conductor, a first electrically conductive shield surrounding the cable core and bonded thereto, a second electrically conductive shield surrounding the first shield, and a cable jacket surrounding the second shield and bonded thereto. An interstitial layer is located between the first and second shields and is composed of axially displaceable elongate strands and is typically composed of helically served yarns or metal wires. The present invention also includes a method of making a shielded cable.

12 Claims, 3 Drawing Sheets

U.S. PATENT DOCUMENTS

| | | | | |
|---|---|---|---|---|
| 2,446,387 | | 8/1948 | Peterson . | |
| 2,479,924 | | 8/1949 | Gillis . | |
| 3,051,771 | | 8/1962 | Lee . | |
| 3,060,261 | | 10/1962 | Stanley et al. . | |
| 3,088,995 | | 5/1963 | Baldwin . | |
| 3,193,712 | | 7/1965 | Harris . | |
| 3,233,036 | | 2/1966 | Jachimowicz . | |
| 3,259,684 | | 7/1966 | Wakefield . | |
| 3,321,572 | | 5/1967 | Garner . | |
| 3,340,353 | * | 9/1967 | Mildner | 174/106 R |
| 3,439,111 | | 4/1969 | Miracle et al. . | |
| 3,459,877 | | 8/1969 | Bullock et al. . | |
| 3,484,532 | | 12/1969 | Anderson . | |
| 3,507,978 | | 4/1970 | Jachimowicz . | |
| 3,588,317 | * | 6/1971 | Hutchis, Jr. | 174/108 |
| 3,590,141 | | 6/1971 | Mildner . | |
| 3,624,267 | | 11/1971 | Plummer . | |
| 3,643,007 | * | 2/1972 | Roberts et al. | 174/106 R |
| 3,662,090 | | 5/1972 | Grey . | |
| 3,773,965 | | 11/1973 | Reynolds . | |
| 3,780,206 | | 12/1973 | Reynolds . | |
| 3,927,247 | | 12/1975 | Timmons . | |
| 3,971,871 | | 7/1976 | Haynes et al. . | |
| 4,092,452 | | 5/1978 | Hori et al. . | |
| 4,117,260 | | 9/1978 | Wilkenloh . | |
| 4,125,739 | | 11/1978 | Bow . | |
| 4,131,759 | * | 12/1978 | Felkel | 174/108 X |
| 4,297,522 | | 10/1981 | Jesse et al. . | |
| 4,323,721 | | 4/1982 | Kincaid et al. . | |
| 4,327,246 | | 4/1982 | Kincaid . | |
| 4,374,299 | | 2/1983 | Kincaid . | |
| 4,376,920 | | 3/1983 | Smith . | |
| 4,378,462 | | 3/1983 | Arnold, Jr. et al. . | |
| 4,406,914 | | 9/1983 | Kincaid . | |
| 4,408,089 | | 10/1983 | Nixon . | |
| 4,439,633 | | 3/1984 | Grooten . | |
| 4,477,693 | | 10/1984 | Krabec et al. . | |
| 4,487,996 | | 12/1984 | Rabinowitz et al. . | |
| 4,510,346 | * | 4/1985 | Bursh, Jr. et al. | 174/36 |
| 4,513,170 | | 4/1985 | Apodaca . | |
| 4,563,540 | | 1/1986 | Bohannon, Jr. et al. . | |
| 4,569,704 | | 2/1986 | Bohannon, Jr. et al. . | |
| 4,595,431 | | 6/1986 | Bohannon, Jr. et al. . | |
| 4,626,810 | | 12/1986 | Nixon . | |
| 4,641,110 | | 2/1987 | Smith . | |
| 4,678,865 | | 7/1987 | Sherwin . | |
| 4,691,081 | | 9/1987 | Gupta et al. . | |
| 4,698,028 | | 10/1987 | Caro et al. . | |
| 4,746,767 | | 5/1988 | Gruhn . | |
| 4,816,614 | | 3/1989 | Baigrie et al. . | |
| 4,871,883 | | 10/1989 | Guiol . | |
| 4,912,283 | | 3/1990 | O'Connor . | |
| 4,965,412 | | 10/1990 | Lai et al. . | |
| 4,987,394 | | 1/1991 | Harman et al. . | |
| 5,006,670 | | 4/1991 | Plant . | |
| 5,061,823 | * | 10/1991 | Carroll | 174/106 R X |
| 5,095,176 | | 3/1992 | Harbrecht et al. . | |
| 5,107,076 | | 4/1992 | Bullock et al. . | |
| 5,132,491 | | 7/1992 | Mulrooney et al. . | |
| 5,133,034 | * | 7/1992 | Arroyo et al. | 385/107 |
| 5,170,010 | | 12/1992 | Aldissi . | |
| 5,210,377 | | 5/1993 | Kennedy et al. . | |
| 5,216,202 | | 6/1993 | Yoshida et al. . | |
| 5,216,204 | | 6/1993 | Dudek et al. . | |
| 5,218,167 | | 6/1993 | Gasque, Jr. . | |
| 5,237,635 | | 8/1993 | Lai . | |
| 5,249,248 | | 9/1993 | Arroyo et al. . | |
| 5,254,188 | | 10/1993 | Blew . | |
| 5,262,592 | | 11/1993 | Aldissi . | |
| 5,274,712 | | 12/1993 | Lindsay et al. . | |
| 5,293,001 | | 3/1994 | Gebs . | |
| 5,321,202 | | 6/1994 | Hillburn . | |
| 5,329,064 | | 7/1994 | Tash et al. . | |
| 5,367,123 | | 11/1994 | Plummer, III et al. . | |
| 5,389,736 | | 2/1995 | Ziemek et al. . | |
| 5,414,213 | | 5/1995 | Hillburn . | |
| 5,434,354 | | 7/1995 | Baker et al. . | |
| 5,457,287 | | 10/1995 | Shimozawa et al. . | |
| 5,473,113 | | 12/1995 | Aldissi . | |
| 5,475,185 | | 12/1995 | Tokarsky . | |
| 5,481,635 | * | 1/1996 | Arroyo et al. | 385/103 |
| 5,521,331 | | 5/1996 | Hillburn . | |
| 5,656,796 | | 8/1997 | Marinos et al. . | |
| 5,796,042 | * | 8/1998 | Pope | 174/102 SP |

* cited by examiner

SHIELDED CABLE AND METHOD OF MAKING SAME

FIELD OF THE INVENTION

The invention relates to a shielded cable and more particularly, to a non-braided drop cable for the transmission of RF signals.

BACKGROUND OF THE INVENTION

In the transmission of RF signals such as cable television signals, a drop cable is generally used as the final link in bringing the signals from a trunk and distribution cable directly into a subscriber's home. Conventional drop cables include an insulated center conductor that carries the signal and a conductive shield surrounding the center conductor to prevent signal leakage and interference from outside signals. In addition, the drop cable generally includes a protective outer jacket to prevent moisture from entering the cable. One common construction for drop cable includes an insulated center conductor, a laminated tape formed of metal and polymer layers surrounding the center conductor, a layer of braided metallic wires, and an outer protective jacket.

One problem with conventional braided drop cable is that it is difficult to attach to standard connectors. In particular, the braided shield is difficult to cut and attach to a standard connector and normally must be folded back over the cable jacket during connectorization of the cable. As a result, the metal braid increases installation time and costs. Furthermore, forming the metal braid is generally a time intensive process and limits the rate at which the cable can be produced. Therefore, there have been attempts in the industry to eliminate the braid from conventional drop cable.

For example, U.S Pat. Nos. 5,321,202; 5,414,213; and 5,521,331 to Hillburn teach replacing the outer braided shield of the conventional construction with a metallic foil shield or laminated metallic tape shield and adding a plastic layer between this shield and the inner shielding tape. Although this construction eliminates metal braids, it creates other connectorization problems. Specifically, when connectors are attached to these cables, a special coring or trimming tool is required to prepare the cable for the connector to be attached to the cable. This requires additional time during the connectorization of these cables.

Furthermore, the connector pull-off force of the braidless cable, i.e., the force needed to pull the connector off of the cable, is undesirably reduced as compared to braided cables.

SUMMARY OF THE INVENTION

The present invention provides a non-braided drop cable that can be easily attached to a connector and that can properly anchor a connector to prevent connector pull-off once the cable is connectorized. Furthermore, the present invention provides a drop cable with sufficient shielding to prevent signal leakage and interference from extraneous signals.

These features are provided by a non-braided shielded cable that includes a cable core comprising a center conductor and a dielectric layer surrounding the center conductor, a first electrically conductive shield surrounding the cable core and bonded thereto, a second electrically conductive shield surrounding the first shield, and a cable jacket surrounding the second shield and bonded thereto. According to the invention, an interstitial layer is located between the first and second shields and is composed of elongate strands disposed between said first and second shields so as to be freely displaceable axially while also serving to space the first and second shields apart from one another.

In a preferred embodiment of the invention, the first and second shields used in the cable are bonded metal-polymer-metal laminate tapes extending longitudinally of the cable and having overlapping longitudinal edges to produce 100% shielding coverage of the center conductor. Preferably, the first shielding tape is an aluminum-polyolefin-aluminum laminate tape and the second shielding tape is an aluminum-polyester-aluminum laminate tape. The strands of the interstitial layer are typically helically wound around the first shielding tape and are formed of metal wires and/or textile yarns. Preferably, these strands are metal wires covering less than 30 percent of the surface of the underlying first shielding tape. The metal wires can be provided as more than one layer having different orientations such as two layers have opposite helical orientations (e.g., counterclockwise and clockwise). The yarns for the interstitial layer typically cover less than 50 percent of the surface of the first shielding tape and are selected from the group consisting of polyester, cotton and aramid yarns and blends thereof. The interstitial layer can include both yarns and metal wires disposed alongside the yarns, and can also include a water blocking material.

The present invention also provides a method of making a shielded cable. In the manufacture of these cables, a cable core comprising a center conductor and a dielectric layer surrounding the center conductor is advanced and a first electrically conductive shielding tape is longitudinally wrapped or "cigarette-wrapped" around the cable core. The interstitial layer is applied to the first shielding cable typically by helically wrapping the strands around the first shielding tape. A second shielding tape is then longitudinally wrapped over the interstitial layer and a cable jacket extruded over the second shielding tape to produce the cable. Preferably, the method further comprises bonding the first shielding tape to the cable core and bonding the second shielding tape to the jacket. The shielding tapes are preferably bonded metal-polymer-metal laminate tapes having longitudinal edges that are positioned in an overlapping relationship. These laminate tapes also preferably include an adhesive on one surface thereof, with the first shielding tape including an adhesive on the inwardly facing surface adjacent the cable core and the second shielding tape including an adhesive on the outwardly facing surface over which the outer jacket is extruded to provide the desired bonds in the shielded cable.

The shielded cables of the invention are easy to attach to standard connectors. Specifically, because the shielded cable is not braided, the problems associated with braids are not experienced during connectorization of the shielded cable of the invention. In addition, the interstitial layer in the cable of the invention is composed of strands that are axially displaceable and thus do not require trimming prior to connectorization. Furthermore, these axially displaceable strands assist in anchoring the connector to the cable, thus increasing the pull-off resistance of the cable.

BRIEF DESCRIPTION OF THE DRAWINGS

Other features and advantages of the present invention will become apparent from the following detailed description of the invention taken in conjunction with the drawings, in which.

DETAILED DESCRIPTION OF THE PREFERRED EMBODIMENTS

Figure 1:
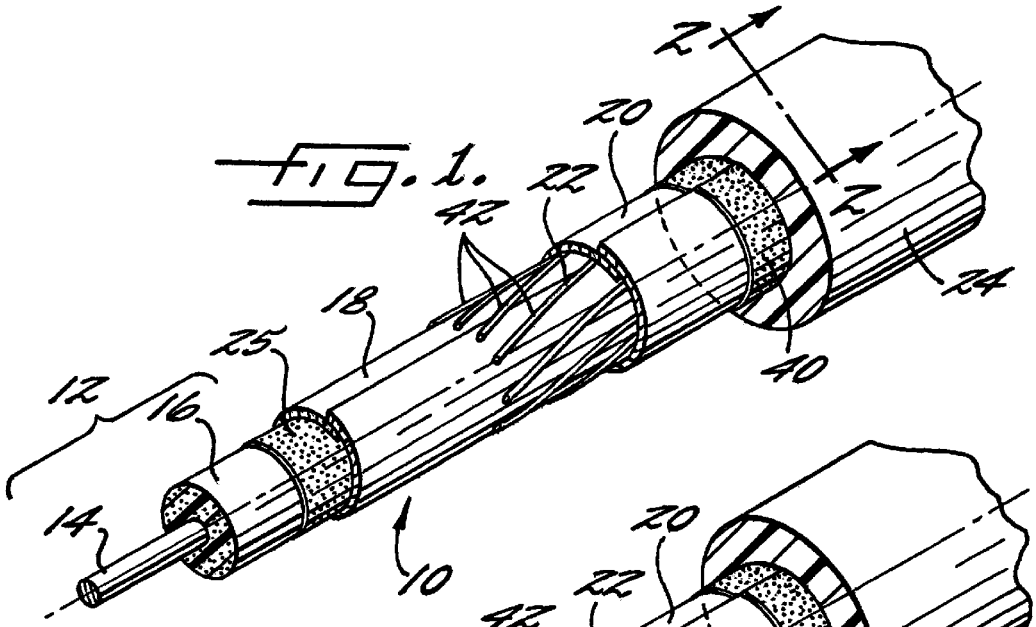
FIG. 1 is a perspective view of a shielded cable according to the invention having portions thereof partially removed for purposes of illustration.
Figure 2:
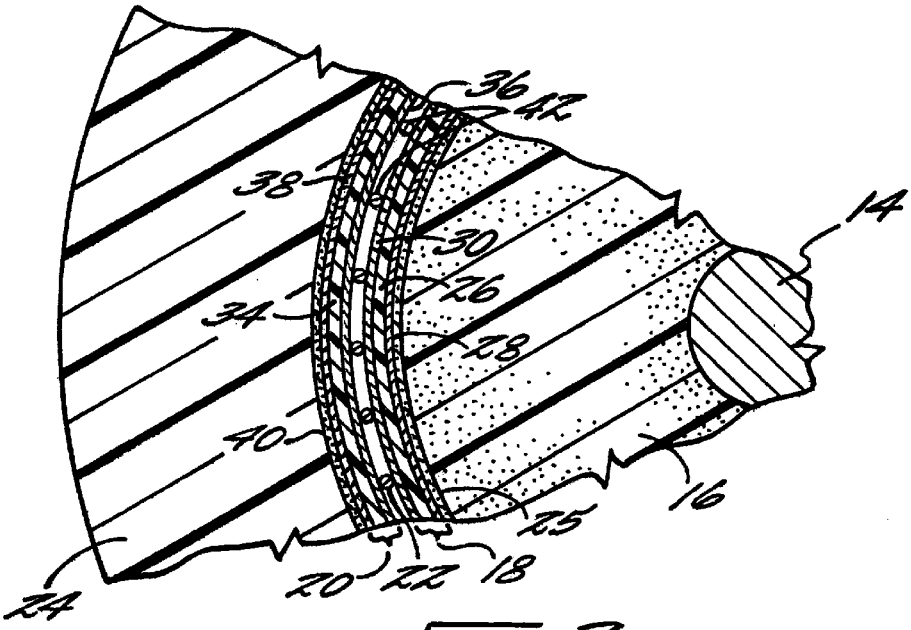
FIG. 2 is a partial cross-sectional view of the shielded cable of FIG. 1 taken along line 2—2.

Referring now to FIGS. 1 and 2, there is shown a shielded cable 10 in accordance with the present invention. The shielded cable 10 is generally known as a drop cable and is used in the transmission of RF signals such as cable television signals. Typically, the over-the-jacket diameter of the cable 10 is between about 0.24 and 0.41 inches.

The cable 10 includes a cable core 12 comprising an elongate center conductor 14 and a dielectric layer 16 surrounding the center conductor. A first shield preferably formed of a first shielding tape 18 surrounds the cable core 12 and is bonded thereto. A second shield preferably formed of a second shielding tape 20 surrounds the first shielding tape. The first and second shielding tapes 18 and 20 prevent leakage of the signals being transmitted by the center conductor 14 and interference from outside signals. An interstitial layer 22 is located between the shielding tapes 18 and 20 and spaces the shielding tapes apart from one another. A cable jacket 24 surrounds the second shielding tape 20 to protect the cable from moisture and other environmental effects and is bonded to the second shielding tape.

As mentioned above, the center conductor 14 in the shielded cable 10 of the invention is generally used in the transmission of RF signals such as cable television signals. The center conductor 14 is preferably formed of copper clad steel wire but other conductive wire (e.g. copper) can also be used. The dielectric layer 16 can be formed of either a foamed or a solid dielectric material. Preferably, the dielectric layer 16 is a material that reduces attenuation and maximizes signal propagation such as a foamed polyethylene. In addition, solid polyethylene may be used.

The cable 10 further includes a first or inner shielding tape 18 surrounding the cable core 12 and bonded to the cable core by an adhesive layer 25. The longitudinal edges of the first shielding tape 18 are typically overlapped so that 100% shielding coverage is provided by the first shielding tape. The first shielding tape 18 includes at least one conductive layer such as a thin metallic foil layer. Preferably, the first shielding tape 18 is a bonded laminate tape including a polymer layer 26 with metal layers 28 and 30 bonded to opposite sides of the polymer layer. The polymer layer 26 is typically a polyolefin (e.g. polypropylene) or a polyester film. The metal layers 28 and 30 are typically thin aluminum foil layers. To prevent cracking of the aluminum in bending, the aluminum foil layers can be formed of an aluminum alloy having generally the same tensile and elongation properties as the polymer layer. Tapes having this construction are available under the HYDPA® trademark from Neptco. In addition, the first shielding tape 18 preferably also includes an adhesive on one surface thereof to provide the adhesive layer 25 between the first shielding tape and the cable core 12. The adhesive is typically formed of an ethylene-acrylic acid (EAA), ethylene-vinyl acetate (EVA), or ethylene methylacrylate (EMA) copolymer or other suitable adhesive. Preferably, the first shielding tape 18 is formed of a bonded aluminum-polypropylene-aluminum laminate tape with an EAA copolymer adhesive.

A second or outer shielding tape 20 surrounds the first shielding tape 18 and also provides shielding of the center conductor 14. The longitudinal edges of the second shielding tape 20 are typically overlapped and the second shielding tape is preferably bonded to the cable jacket 24. The second shielding tape 20 includes at least one conductive layer such as a thin metallic foil layer and is preferably a bonded laminate tape including a polymer layer 34 with metal layers 36 and 38 bonded to opposite sides of the polymer layer as described above. However, to provide added strength and connector retention to the shielded cable 10, the second shielding tape 20 is preferably a bonded aluminum-polyester-aluminum laminated tape. In addition, to prevent cracking of the aluminum in bending, the second shielding tape 20 can include aluminum alloy foil layers having generally the same tensile and elongation properties as the polyester such as described above with respect to the first shielding tape 18. The second shielding tape 20 typically also includes an adhesive on one surface thereof that forms an adhesive layer 40 to provide a bond between the second shielding tape and the cable jacket 24. Preferably, the adhesive is an EAA copolymer for polyethylene jackets and an EVA copolymer for polyvinyl chloride jackets.

In between the first shielding tape 18 and the second shielding tape 20 is provided an interstitial layer 22 that spaces the shielding tapes apart from one another. The interstitial layer 22 is composed of elongate strands 42 disposed between the first shielding tape 18 and the second shielding tape 20. The elongate strands 42 are positioned and arranged between the tapes 18 and 20 in such a way that they are freely displaceable axially. As described in more detail below, this allows the strands 42 to be displaced when the cable 10 is attached to a standard connector. In the illustrated embodiment, this is achieved by the strands being loosely arranged between the tapes 18 and 20 without any bonding to one another or to the tapes. Alternatively, a binding agent or adhesive could be utilized to stabilize the strands during manufacture, so long as the bond is relatively weak and permits axial displacement of the strands during connectorization.

The strands 42 forming the interstitial layer 22 are preferably helically arranged about the first shielding tape 20. Preferably, the strands 42 are metal wires or textile yarns. Metal wires are especially preferred because they impart more strength, provide a conductive bridge between the shielding layers, and increase the strength of the attachment between the cable and connector. Exemplary wires include copper or aluminum wires having a generally circular cross-section and a diameter of up to about 0.01 inch. The metal wires can be applied in one layer having a predetermined helical orientation or in more than one layer (e.g. two layers) with each layer having alternating opposite helical orientations. For example, a first layer of wires can be applied in a clockwise orientation and a second layer of wires applied in a counterclockwise orientation. In any event, the metal wires are applied such that they are freely displaceable axially and thus are not interlaced in the manner used to make braided wires. To that end, the metal wires preferably cover less than 30 percent of the surface of the underlying shielding tape 18, and more preferably between about 10 and 20 percent of the surface of the underlying shielding tape.

As mentioned above, the strands 42 can also be composed of textile yarns. Exemplary yarns include polyester, aramid and cotton yarns, and blends thereof. Preferably, the yarns are continuous multifilament polyester yarns. The yarns can also be semiconductive or contain conductive filaments or fibers to provide a conductive bridge between the shielding tapes 18 and 20. The yarns can suitably provide less than 50 percent coverage of the underlying shielding tape 18 and, for example, may cover between 20 and 40 percent of the surface of the first shielding tape. The yarns are preferably helically arranged about the first shielding tape 18 and can be used alone to form the interstitial layer 22 or can be combined with metal wires. For example, the yarns and metal wires can be disposed alongside one another to form the interstitial layer 22 or in separate layers as described above.

The interstitial layer 22 can also include a water blocking material to trap any moisture that may enter the cable 10 and prevent corrosion of the metal layers in the cable. The water blocking material can, for example, include a water swellable powder such as a polyacrylate salt (e.g. sodium polyacrylate). This water blocking powder can be provided in the yarns used as strands 42 in the interstitial layer 22, applied to the strands in the interstitial layer, or provided on the surface of the first or second shielding tape 18 or 20 adjacent the interstitial layer.

As shown in FIGS. 1 and 2, the cable 10 generally also includes a protective jacket 24 surrounding the second shielding tape 20. The jacket 24 is preferably formed of a non-conductive material such as polyethylene or polyvinyl chloride. Alternatively, a low smoke insulation such as a fluorinated polymer can be used if the cable 10 is to be installed in air plenums requiring compliance with the requirements of UL910.

Figure 3:
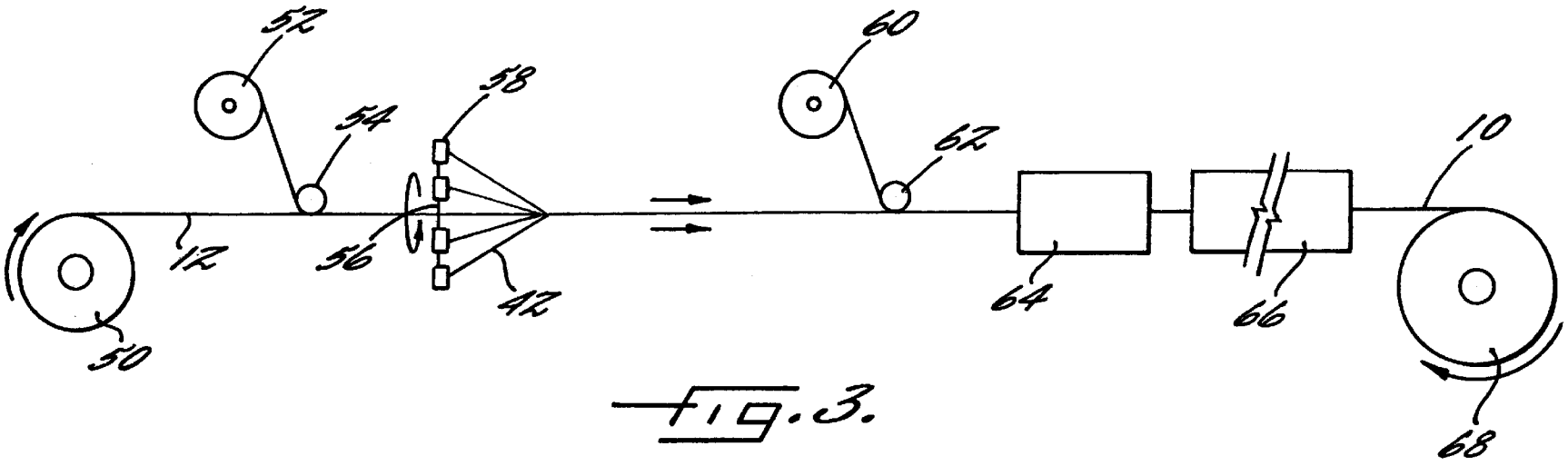
FIG. 3 is a schematic illustration of a method of making a shielded cable according to the invention.

FIG. 3 illustrates a preferred method of making the shielded cable 10 of the invention. As shown in FIG. 3, the cable core 12 comprising a center conductor 14 and surrounding dielectric layer 16 is advanced from a reel 50. As the cable core 12 is advanced, a first shielding tape 18 is supplied from a reel 52 and longitudinally wrapped or "cigarette-wrapped" around the cable core. As mentioned above, the first shielding tape 18 is preferably a bonded metal-polymer-metal laminate tape having an adhesive on one surface thereof. The first shielding tape 18 is applied with the adhesive surface positioned adjacent the underlying cable core 12. If an adhesive layer is not already included on the first shielding tape 18, an adhesive layer can be applied by suitable means such as extrusion prior to longitudinally wrapping the first shielding tape around the core 12. One or more guiding rolls 54 direct the first shielding tape 18 around the cable core with longitudinal edges of the first shielding tape overlapping to provide 100% shielding coverage of the cable core 12.

The wrapped cable core is next advanced to a creel 56 that helically winds or "serves" the strands 42 around the first shielding tape 18 to form the interstitial layer 22. The creel 56 preferably includes only as many spools 58 as are necessary to provide the desired coverage of the first shielding tape 18 described above. The creel 56 rotates in either a clockwise or counterclockwise direction to provide helical winding of the strands 42. Additional creels (not shown) can also be included to produce more than one layer of strands 42 in the interstitial layer 22. In addition, if a water blocking material is not provided in the strands 42 or on the surface of the first or second shielding tapes 18 or 20, a water swellable powder can be applied to the interstitial layer 22 by suitable means (not shown) to prevent the migration of moisture in the cable 10.

Once the interstitial layer 22 has been applied, a second shielding tape 20 is provided from a reel 60 and longitudinally wrapped around the interstitial layer. As mentioned above, the second shielding tape 20 is preferably a bonded metal-polymer-metal laminate tape having an adhesive layer on one surface thereof. The second shielding tape 20 is applied with the adhesive layer facing outwardly away from the interstitial layer 22, i.e, adjacent the cable jacket 24. One or more guiding rolls 62 direct the second shielding tape 20 around the interstitial layer 22 with longitudinal edges of the second shielding tape overlapping to provide 100% shielding coverage.

The cable is then advanced to an extruder apparatus 64 and a polymer melt is extruded at an elevated temperature around the second shielding tape 20 to form the cable jacket 24. If the second shielding tape 20 does not already include an adhesive, an adhesive layer 40 can be applied to the second shielding tape by suitable means such as coating or extrusion, or it can be coextruded with the cable jacket 24. The heat from the extruded melt generally activates the adhesive layers 25 and 40 to provide a bond between the cable core 12 and first shielding tape 18, and between the second shielding tape 20 and the jacket 24. Once the protective jacket 24 has been applied, the cable is quenched in a cooling trough 66 to harden the jacket and the cable is taken up on a reel 68.

Figure 4:
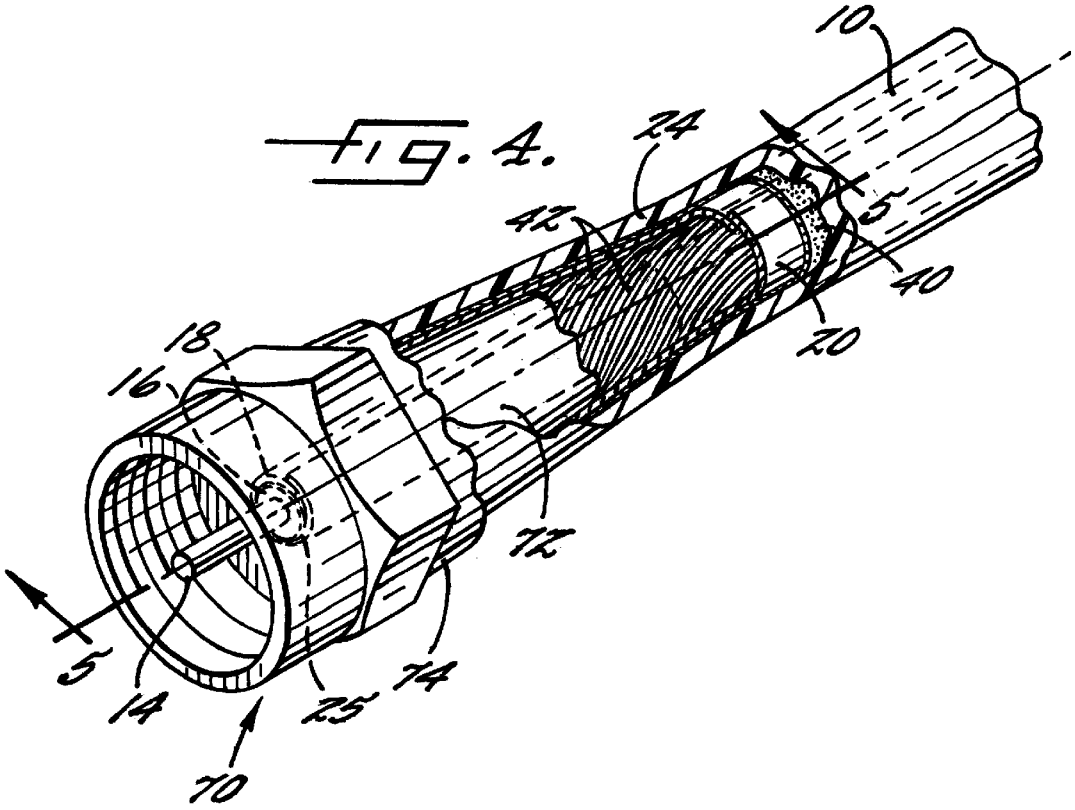
FIG. 4 is a perspective view of a shielded cable according to the invention attached to a standard one-piece connector and with portions broken away for purposes of illustration.
Figure 5:
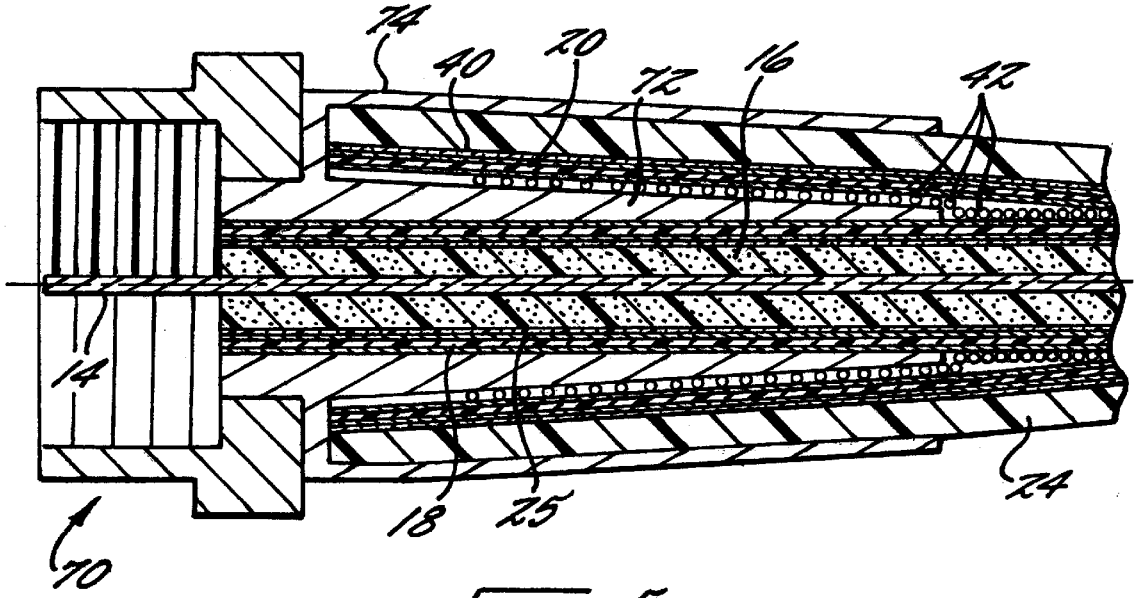
FIG. 5 is a longitudinal cross-sectional view of the connectorized cable of FIG. 4 taken along line 5—5.

FIGS. 4 and 5 illustrate the shielded cable 10 of the invention attached to a standard connector 70. The connector 70 shown in FIGS. 4 and 5 is a threaded one-piece connector of the type conventionally used in the cable television industry. However, other types of connectors such as two-piece compression connectors could also be used in accordance with the invention.

The standard one-piece connector 70 typically includes an inner sleeve or bushing 72 and an outer sleeve 74. As shown in FIG. 5, to attach the shielded cable 10 of the invention to the connector 70, the shielded cable is typically prepared by cutting away a portion of the dielectric 16 and first shielding tape 18 to expose a short length (e.g. ¼ of an inch) of the center conductor 14 protruding from the dielectric. The second shielding tape 20 and jacket 24 are stripped away an additional short length (e.g. ¼ of an inch) exposing the dielectric 16 and first shielding tape 18. The connector 70 is then attached to the cable 10 by inserting the bushing 72 between the shielding tapes 18 and 20 and inserting the outer sleeve 74 around the jacket 24. The outer sleeve 74 is then crimped down onto the cable 10 using a suitable crimping tool to complete connectorization of the cable. Because the strands 42 forming the interstitial layer 22 are freely moveable between the two shielding tapes 18 and 20, the strands are pushed back axially as the connector bushing 72 is inserted. Insertion of the connector does not require special preparation or use of a coring tool. As best shown in FIG. 5, a portion of the axially displaced strands 42 become lodged or tucked between the connector bushing 72 and the second shielding tape 20. These strands 42 serve to help anchor the connector bushing 72 in the cable 10 and thus increase the pull-off resistance of the cable, i.e., the force necessary to pull the connector 70 off of the cable.

The benefits of the invention can be demonstrated by determining the pull-off force between cables and standard connectors using the test method described in Society of Cable Telecommunications Engineers (SCTE) Document IPS-TP-401, issued Jan. 17, 1994 and entitled "Test Method for Axial Pull Connector/Cable." Using this method, RG6 cables having an over the jacket diameter of 0.272 inch were compared. Cable A was constructed using metal wires according to the invention and Cable B was constructed using a foamed polyvinyl chloride layer between shielding tapes. The results are provided in Table 1 and demonstrate the increased pull-off resistance of the cables according to the invention.

TABLE 1

| Connector/Cable | Connector Pull-Off Force |
|---|---|
| One Piece Crimp Connector: | |
| Cable A | 64 $lb_f$ |
| Cable B | 30 $lb_f$ |
| Two Piece Compression Connector: | |
| Cable A | 61 $lb_f$ |
| Cable B | 37 $lb_f$ |

In addition to providing ease of connectorization and enhanced connector pull-off resistance, the shielded cable 10 of the invention can be produced at a better rate than conventional braided cables and at lower cost. Furthermore, the shielded cable sufficiently shields the RF signals carried by the center conductor. Accordingly, the shielded cable 10 of the invention overcomes many of the problems associated with prior art cables.

It is understood that upon reading the above description of the present invention and reviewing the accompanying drawings, one skilled in the art could make changes and variations therefrom. These changes and variations are included in the spirit and scope of the following appended claims.

That which is claimed:

1. A shielded cable comprising:

a cable core comprising a center conductor and a dielectric layer surrounding the center conductor;

a first electrically conductive shield surrounding said cable core and bonded thereto;

a second electrically conductive shield surrounding said first shield;

said first and second shields comprising bonded metal-polymer-metal laminate tapes, each extending longitudinally of the cable and having overlapping longitudinal edges;

a cable jacket surrounding said second shield and bonded thereto; and an interstitial layer located between said first and second shields, said interstitial layer being composed of elongate strands disposed between said first and second shields so as to be freely displaceable axially while also serving to space said first and second shields apart from one another.

2. The shielded cable according to claim 1, wherein said first shield comprises an aluminum-polyolefin-aluminum laminate tape and said second shield comprises an aluminum-polyester-aluminum laminate tape.

3. The shielded cable according to claim 1, wherein said interstitial layer is formed from a first plurality of metal wires helically arranged about the first shield.

4. The shielded cable according to claim 3, wherein said interstitial layer further comprises a second plurality of metal wires helically arranged about the first plurality of metal wires and having a helical orientation opposite the orientation of the first plurality of metal wires.

5. The shielded cable according to claim 3, wherein the first plurality of metal wires covers less than 30 percent of the surface of the underlying first shield.

6. The shielded cable according to claim 1, wherein said interstitial layer further comprises a water blocking material.

7. A shielded cable comprising:

a cable core comprising a center conductor and a dielectric layer surrounding the center conductor;

a first electrically conductive shield surrounding said cable core and bonded thereto;

a second electrically conductive shield surrounding said first shield;

a cable jacket surrounding said second shield and bonded thereto; and an interstitial layer located between said first and second shields, said interstitial layer being formed from yarns helically arranged about the first shield so as to be freely displaceable axially while also serving to space said first and second shield apart from one another.

8. The shielded cable according to claim 7, wherein yarns are arranged in a single layer and cover less than 50 percent of the surface of the underlying first shield.

9. The shielded cable according to claim 7, wherein said yarns are selected from the group consisting of polyester, cotton and aramid yarns and blends thereof.

10. The shielded cable according to claim 7, wherein said interstitial layer additionally includes metal wires disposed alongside said yarns.

11. A shielded cable comprising:

a cable core comprising a center conductor and a dielectric layer surrounding the center conductor;

a first shielding tape formed of a bonded aluminum-polypropylene-aluminum laminate applied in an overlapping arrangement about said cable core and bonded thereto;

an interstitial layer surrounding said first shielding tape and comprising elongate metal wires helically arranged about said first shielding tape and covering less than 30 percent of the surface of the first shielding tape;

a second shielding tape formed of a bonded aluminum-polyester-aluminum laminate applied in overlapping arrangement about said interstitial layer; and a cable jacket surrounding said second shielding tape and bonded thereto;

said metal wires of said interstitial layer being freely displaceable axially while also serving to space said first and second shielding tapes apart from one another.

12. A shielded cable comprising:

a cable core comprising a center conductor and a dielectric layer surrounding the center conductor;

a first electrically conductive shield surrounding said cable core and bonded thereto;

a second electrically conductive shield surrounding said first shield;

a cable jacket surrounding said second shield and bonded thereto; and an interstitial layer located between said first and second shields, said interstitial layer being composed of elongate metal wires disposed between said first and second shields so as to be freely displaceable axially while also serving to space said first and second shields apart from one another, said interstitial layer including a first plurality of metal wires helically arranged about the first shield and a second plurality of metal wires helically arranged about the first plurality of metal wires and having a helical orientation opposite the orientation of the first plurality of metal wires.

* * * * *

UNITED STATES PATENT AND TRADEMARK OFFICE

CERTIFICATE OF CORRECTION

PATENT NO. : 6,246,006 B1
DATED : June 12, 2001
INVENTOR(S) : Hardin et al.

Figure 1A:
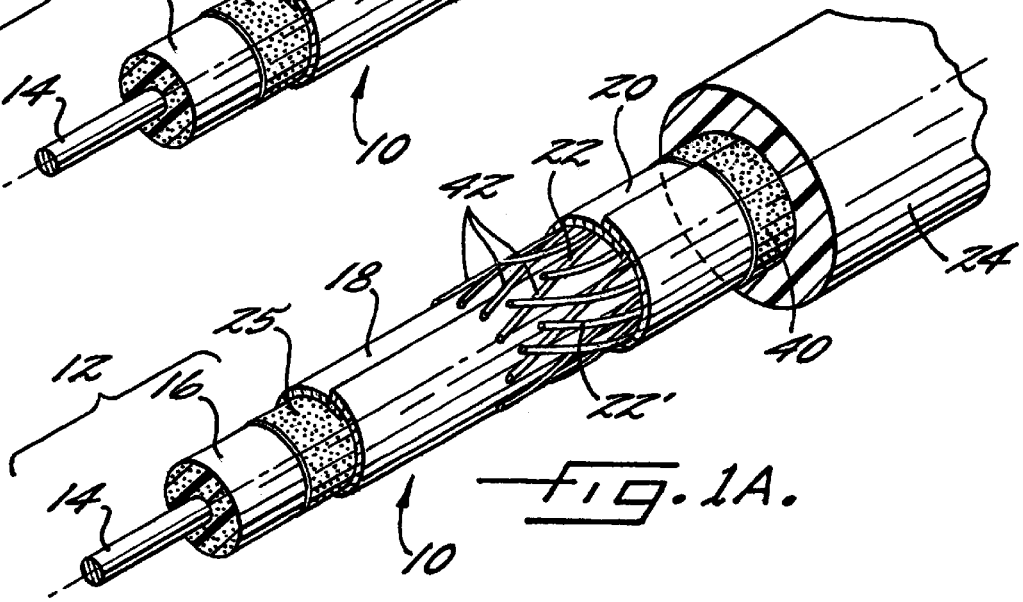

It is certified that error appears in the above-identified patent and that said Letters Patent is hereby corrected as shown below:

Column 2,
Line 67, insert the following: -- FIG. 1A is a perspective view of a shielded cable according to the invention having two layers of wires. --.

Column 4,
Line 58, "orientation", insert -- as shown in FIG. 1A --.

Signed and Sealed this

Twenty-ninth Day of January, 2002

*Attest:*

*Attesting Officer*

JAMES E. ROGAN
*Director of the United States Patent and Trademark Office*